United States Patent [19]

Graf

[11] 4,418,256

[45] Nov. 29, 1983

[54] ELECTRICALLY INSULATING PLASTIC ELEMENT FOR AN ELECTRICAL SWITCHING DEVICE, ESPECIALLY FOR USE AS THE BLAST NOZZLE OF A GAS-BLAST SWITCH

[75] Inventor: Rudolf Graf, Obermuhen, Switzerland

[73] Assignee: Sprecher & Schuh AG, Aarau, Switzerland

[21] Appl. No.: 202,944

[22] Filed: Nov. 3, 1980

[30] Foreign Application Priority Data

Jan. 11, 1980 [CH] Switzerland ..... 197/80

[51] Int. Cl.[3] ..... H01H 33/59

[52] U.S. Cl. ..... 200/148 R; 200/144 C; 200/147 R; 200/149 A

[58] Field of Search ..... 200/144 C, 140 R, 149.1, 200/147 A

[56] References Cited

U.S. PATENT DOCUMENTS

| | | | |
|---|---|---|---|
| 2,337,949 | 12/1943 | Walle | 200/147 A |
| 2,875,302 | 2/1959 | Immel et al. | 200/147 A |
| 3,021,409 | 2/1962 | Cobine et al. | 200/149 A |
| 4,011,426 | 3/1977 | Lange | 200/144 C |

FOREIGN PATENT DOCUMENTS

| | | | |
|---|---|---|---|
| 687791 | 6/1964 | Canada | 200/144 C |
| 1100564 | 1/1968 | United Kingdom | 200/144 C |

*Primary Examiner*—Robert S. Macon
*Attorney, Agent, or Firm*—Werner W. Kleeman

[57] ABSTRACT

A plastic mass of a blast nozzle contains a filler which is at least partially composed of powder of one or more metals. The proportion of metal powder amounts to at most 30 percent by weight, preferably 5 to 15 percent by weight. As the filler there is particularly suitable, alone or in combination, the metals of tungsten, copper, aluminum and iron. The electrically conductive filler prevents penetration of the electromagnetic radiation emanating from the arc into the interior of the blast nozzle, resulting in an appreciable reduction in nozzle burn-off.

10 Claims, 1 Drawing Figure

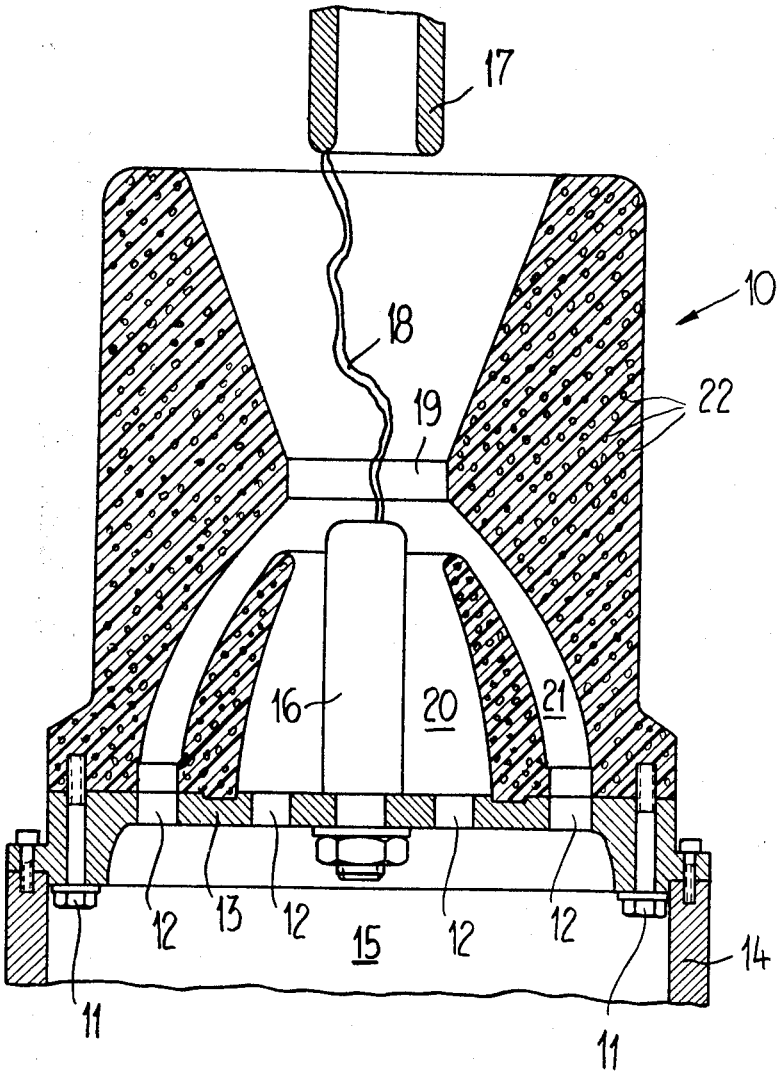
17
10
18
19
22
16
20
21
12
13
12
15
12
12
14
11
11

ELECTRICALLY INSULATING PLASTIC ELEMENT FOR AN ELECTRICAL SWITCHING DEVICE, ESPECIALLY FOR USE AS THE BLAST NOZZLE OF A GAS-BLAST SWITCH

BACKGROUND OF THE INVENTION

The present invention relates to a new and improved construction of an electrically insulating plastic element or part employed for an electrical switching device and to the use of this plastic element as a blast nozzle of a gas-blast switch. The plastic element is exposed to the action of arcs and contains a filler which absorbs electromagnetic radiation.

It is already known from German Pat. No. 1,281,528 and British Pat. No. 1,007,486 that the parts of electrical switching devices exposed to the action of arcs experience an undesired high wear. To avoid this drawback it therefore has already been proposed to provide these parts with a lining which is rendered opaque by a filler.

Furthermore, it is known from Swiss Pat. No. 596,641 to add a filler absorbing electromagnetic radiation to the plastic which is employed for the part or element exposed to the action of the switching arcs.

With these heretofore known solutions the filler is capable of preventing that the radiation emanating from the arcs will deeply penetrate into the lining or the plastic part, as the case may be. Yet, the heretofore employed fillers or filler materials are not capable of sufficiently holding back this radiation in order to prevent destruction of the part or element. Under the action of the radiation, which even only slightly penetrates, there occurs a decomposition of the material directly below the surface of the plastic element or part, and such, in turn, causes the formation of hollow spaces or voids. By virtue of the high electrical fields there occurs within such hollow spaces or voids a glow which causes further destruction of the plastic and a splitting-off of parts of the surface of the plastic element.

SUMMARY OF THE INVENTION

Therefore, with the foregoing in mind, it is a primary object of the present invention to provide a new and improved construction of electrically insulating plastic element for an electrical switching device, especially for use as the blast nozzle of a gas-blast switch, which is not associated with the aforementioned drawbacks and limitations of the prior art constructions.

Another more specific object of the present invention aims at providing a new and improved construction of a plastic element of the previously mentioned type wherein there is markedly reduced the burn-off at the surface of the plastic element and there can be extensively prevented the formation of hollow spaces or voids within the plastic element.

Now in order to implement these and still further objects of the invention, which will become more readily apparent as the description proceeds, the invention is manifested by the features that the filler at least partially consists of metal powder, the proportion of which at most amounts to 30% by weight.

In contrast to heretofore known solutions, wherein there are employed fillers of electrically poor or non-conducting materials, the inventive use of electrically conductive fillers with a proportion of at most 30% by weight of the metal powder produces a surprising reduction in the burn-off at the surface of the plastic element or part, without reducing its electrical strength to an impermissible value. The proportion of metallic filler in the form of powder having a preferred grain size of 2–5 micrometers therefore is capable of effectively preventing the penetration of electromagnetic radiation.

In this connection it is mentioned that the expression "electromagnetic radiation" is employed in its broadest sense, and is to be broadly understood and specifically encompasses the spectrum of ultra-red radiation to visible light, ultraviolet radiation and X-ray radiation.

A particularly pronounced burn-off strength is obtained if the filler at least in part comprises a powder selected from one or more metals of the group consisting of tungsten, copper, aluminum and iron.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE shows in sectional view a blast nozzle of a gas-blast switch constructed according to the invention.

DETAILED DESCRIPTION OF THE PREFERRED EMBODIMENTS

Describing now the drawing, it is to be understood that as a matter of convenience in illustration only enough of the construction of the gas-blast switch has been illustrated as will enable those skilled in the art to readily understand the underlying principles and concepts of the present invention. In particular, there will be seen a blast nozzle 10 which is bolted or otherwise appropriately connected by means of the threaded bolts 11 at a closure wall 13 of a pump cylinder 14. The end face of the closure wall 13 is provided with throughpass openings 12. Out of the internal space or compartment 15 of the blast nozzle 10 there is infed through these openings 12 a suitable extinguishing gas, for instance $SF_6$.

Furthermore, a contact pin 16 is threadably connected or otherwise suitably affixed to the closure wall 13. This contact pin 16 can be brought into and out of engagement with a counter contact 17. Both of the contact elements 16 and 17 are not power contacts of the gas-blast switch, which power contacts have not been shown and to which belongs the blast nozzle 10, rather these contact elements 16 and 17 are those which, upon cut-off of the gas-blast switch, come out of engagement with one another at a point in time following the disengagement of the power contacts. Between these contact element 16 and 17, upon opening of the gas-blast switch, there is formed an arc 18. This arc 18 is blown by the extinguishing gas which flows through two coaxial blast channels 20 and 21 which converge towards the narrowest location or throat 19 of the blast nozzle 10.

The blast nozzle 10 itself is formed of a thermoplastic or duroplastic moldable synthetic resin or a sintered plastic. In both cases the plastic mass is leaned or contains admixed therein a filler or filler material 22 which absorbs the electromagnetic radiation emanating from the arc 18. In the showing of the drawing the filler particles have been depicted exaggerated in size.

They can be used as the moldable plastic, for instance, a modified tetrafluoroethylene and ethylene copolymer having a proportion of at least 60% tetrafluoroethylene, as the same is commercially available for instance under the trademark "TEFZEL".

Equally there can be suitably employed as the moldable plastic material cycloaliphatic epoxy resin.

As an example of a suitable sintered plastics material there is mentioned polytetrafluoroethylene, a product which is commercially known under the trademark "TEFLON" or "HOSTAFLON".

The filler advantageously exists exclusively of powder of one or more metals. Preferably there are employed individually or in combination the following metals: tungsten, copper, aluminum and iron.

However, it is also possible to use as the filler or filler material a mixture of powder of one or more metals containing powder of one or more electrically non-conductive materials.

In any event the proportion of the metal powder should not amount to more than 30% by weight.

The proportion of filler can vary on the average between 5 and 15% by weight, and preferably the filler content is chosen so that at the region of the surface of the blast nozzle confronting the arc it is greater than at the remaining regions.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. An electrically insulating blast nozzle for a gas-blast switch, comprising:

a plastic material forming said electrically insulating blast nozzle;

said plastic material of the blast nozzle containing a filler which essentially prevents penetration of electromagnetic radiation into the interior of the plastic material of the blast nozzle;

said filler consisting of a powder of at least one metal selected from the group consisting essentially of tungsten, copper, aluminum and iron; and the proportion of the metal powder amounting to at most 30% by weight.

2. The electrically insulating blast nozzle as defined in claim 1, wherein:

said plastic material forming said electrically insulating blast nozzle constitutes the major proportion of the material forming said electrically insulating blast nozzle; and said filler modifying the properties of said electrically insulating blast nozzle such as to markedly reduce burn-off at the surface of said electrically insulating blast nozzle due to the effects of electromagnetic radiation.

3. The electrically insulating blast nozzle as defined in claim 1, wherein:

said filler prevents penetration of electromagnetic radiation into the interior of the plastic material of the blast nozzle by absorbing such electromagnetic radiation.

4. The electrically insulating blast nozzle as defined in claim 1, wherein:

the proportion of metal powder amounts to 5 to 15% by weight.

5. The electrically insulating blast nozzle as defined in claim 1, wherein:

the grain size of the metal powder is in the order of 2–5 micrometers.

6. The electrically insulating blast nozzle as defined in claim 1, wherein:

said plastic material of the blast nozzle consists of a moldable plastic which has been leaned with the filler.

7. The electrically insulating blast nozzle as defined in calim 6, wherein:

said moldable plastic contains a modified tetrafluoroethylene and ethylene copolymer having a proportion of at least 60% by weight tetrafluoroethylene.

8. The electrically insulating blast nozzle as defined in claim 1, wherein:

said plastic material of the blast nozzle is formed of a sintered plastic which has been leaned by the filler.

9. The electrically insulating blast nozzle as defined in claim 8, wherein:

said sintered plastic contains polytetrafluoroethylene.

10. The electrically insulating blast nozzle as defined in claim 1, wherein:

said content of filler is greater at the region of a surface of the plastic material of the blast nozzle which is exposed to the action of arcs than at a region internally of the plastic material.

* * * * *